United States Patent [19]

Wolters

[11] 4,204,347

[45] May 27, 1980

[54] DEVICE FOR CUTTING LOOSE HARD GROUND MATERIAL

[75] Inventor: Tjako A. Wolters, Zeist, Netherlands

[73] Assignee: Ballast-Nedam Groep N.V., Amsterdamse Ballast Bagger en Grond (Amsterdam Ballast/Dredging) B.V. and Banegbo B.V., Amstelveen, Netherlands

[21] Appl. No.: 884,708

[22] Filed: Mar. 8, 1978

[30] Foreign Application Priority Data

Mar. 8, 1977 [NL] Netherlands ..... 7702503

[51] Int. Cl.[2] ..... E02F 3/90

[52] U.S. Cl. ..... 37/67; 37/56; 37/72; 37/73

[58] Field of Search ..... 37/56, 58, 67, 72, 73

[56] References Cited

U.S. PATENT DOCUMENTS

| | | | |
|---|---|---|---|
| 832,345 | 10/1906 | Smulders | 37/67 |
| 929,613 | 7/1909 | Lytton | 37/58 |
| 1,962,363 | 6/1934 | Reimel et al. | 37/73 X |
| 2,762,136 | 9/1956 | Bell | 37/67 |
| 3,171,219 | 3/1965 | Kaufmann et al. | 37/56 |
| 3,218,739 | 11/1965 | Kaufmann et al. | 37/56 |
| 3,683,521 | 8/1972 | Sloan et al. | 37/56 |
| 3,755,932 | 9/1973 | Cargile, Jr. | 37/56 X |
| 3,808,716 | 5/1974 | Verbeek | 37/67 |
| 3,893,249 | 7/1975 | Wolters | 37/58 |
| 3,983,707 | 10/1976 | Lezgintser | 37/56 X |
| 4,073,078 | 2/1978 | Leitz | 37/73 X |

FOREIGN PATENT DOCUMENTS

| | | | |
|---|---|---|---|
| 1484523 | 6/1969 | Fed. Rep. of Germany | 37/67 |
| 2021441 | 3/1971 | Fed. Rep. of Germany | 37/58 |
| 6803564 | 9/1969 | Netherlands | 37/67 |
| 238419 | 7/1969 | U.S.S.R. | 37/67 |
| 242759 | 9/1969 | U.S.S.R. | 37/73 |

*Primary Examiner*—Clifford D. Crowder
*Attorney, Agent, or Firm*—John P. Snyder

[57] ABSTRACT

Hard ground beneath a water surface is controllably cut away by a device which includes a buoyant body having a work support depending therefrom and forced against the hard ground so as partially to support the weight of the body. A cutter assembly is releasably clamped to the work support and the clamp has arms connecting it to a short, rigid carrier which mounts a rotatable cutter head at one end. The arms allow the carrier to swing about a horizontal axis and a vertical axis and hydraulic motors are provided to sweep the carrier about such axes in controlled fashion. A winch on the body allows the carrier to be clamped at desired vertical positions on the work support.

15 Claims, 17 Drawing Figures

Figure 1:
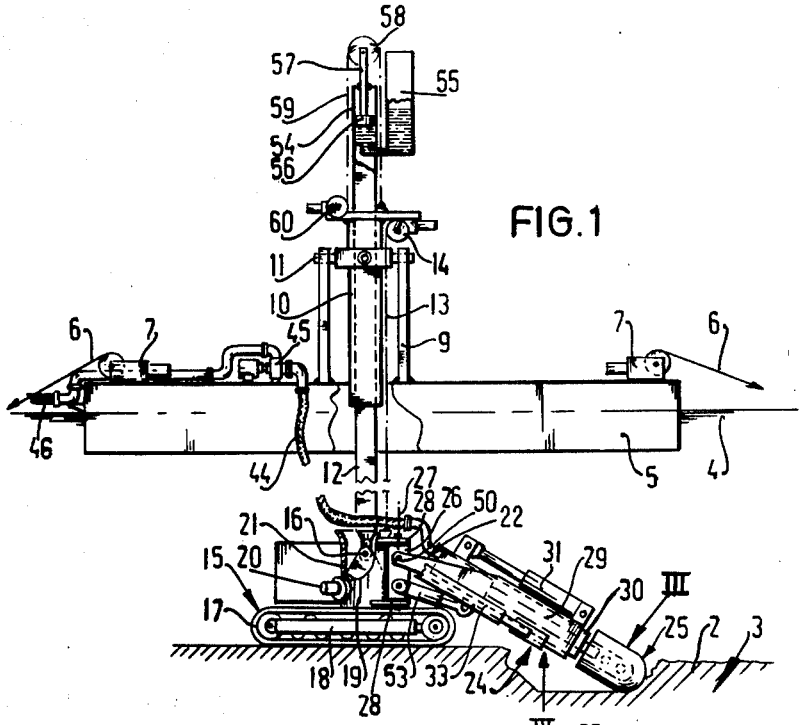

FIG. 4
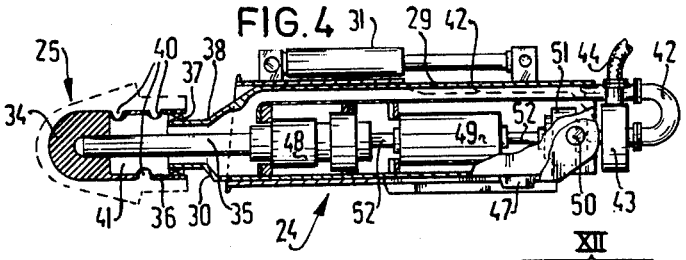
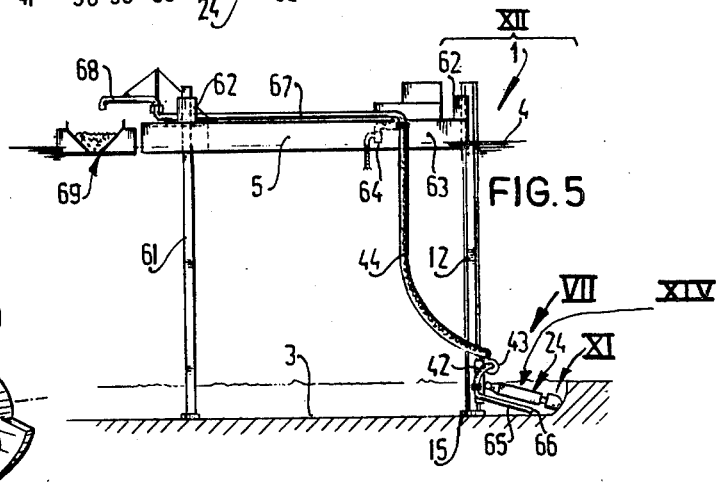
FIG. 5
FIG. 3
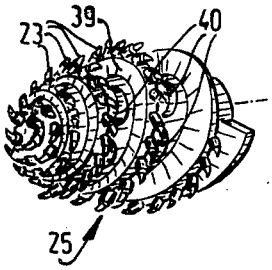
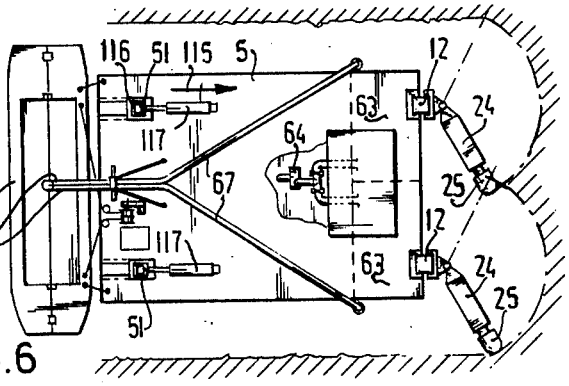
FIG. 6

FIG.7
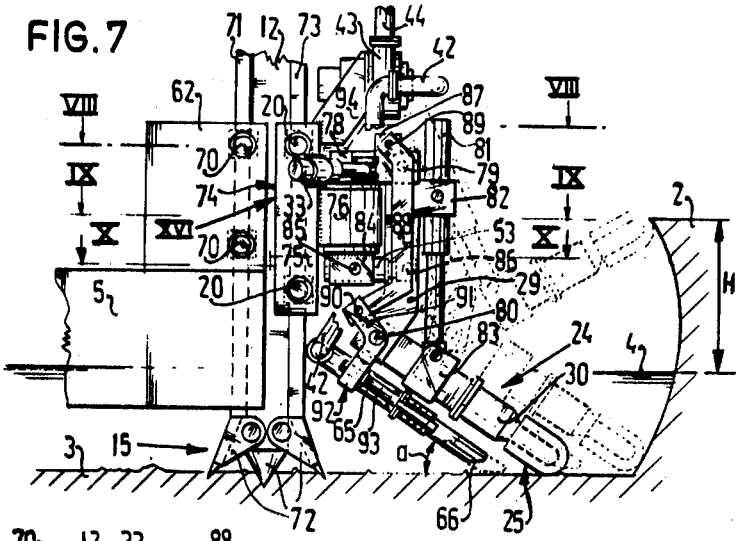
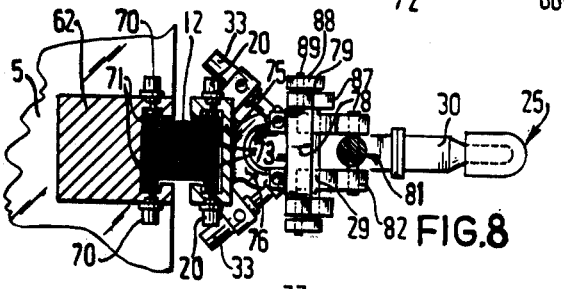
FIG.8
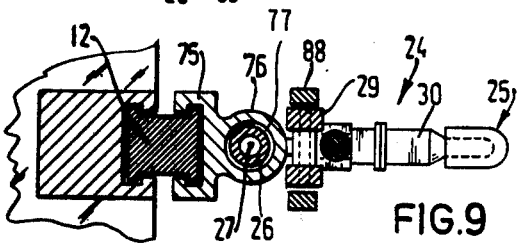
FIG.9
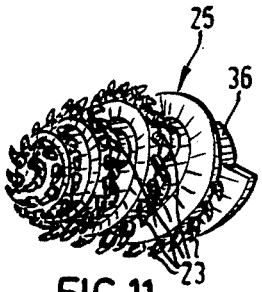
FIG.11
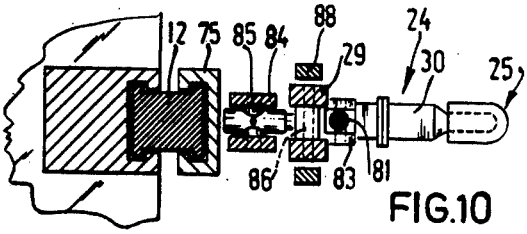
FIG.10

FIG.13
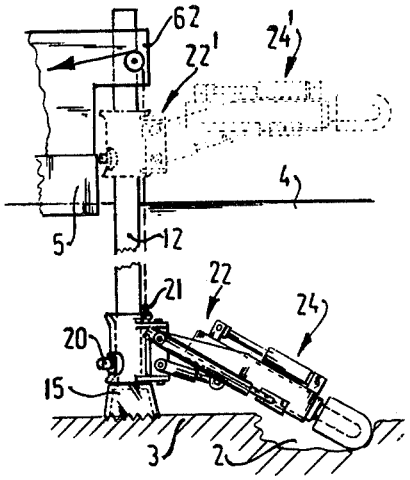
FIG.12
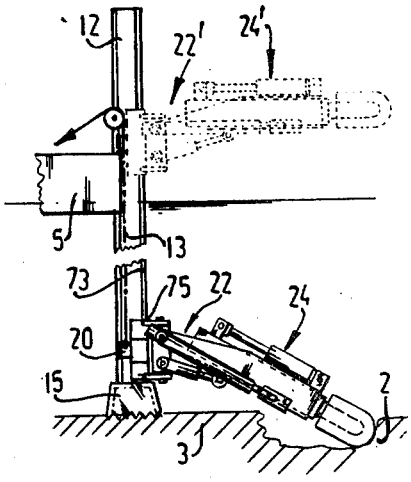
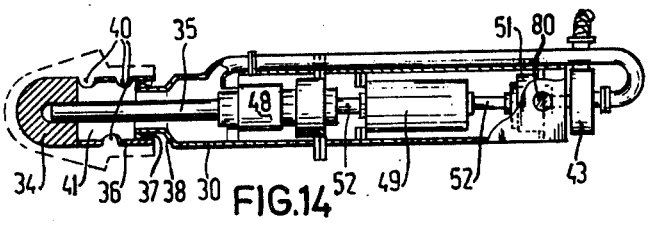
FIG.14
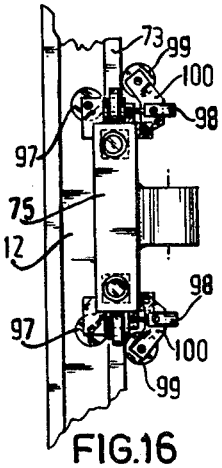
FIG.16
FIG.15
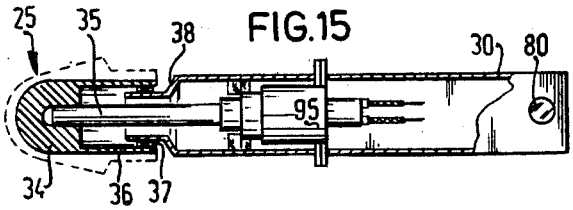

DEVICE FOR CUTTING LOOSE HARD GROUND MATERIAL

The invention relates to a device for cutting loose hard ground material at least from a subaqueous soil comprising a ground support to be arranged under the water, at least one cutting head provided with cutting members, rotatably driven by rotational driving means and rotatably journalled on a carrier, tie means connecting the carrier with the ground support and lateral driving means engaging the carrier and driving the cutting head along the ground in a cut.

Such a device is known from Dutch patent application No. 301,281 laid open for public inspection. This device is not or only hardly suitable for cutting up hard ground material. When the cutting members of the cutting head come into contact with hard ground material, for example, rocks, the tines perform arbitrary, harmful motions under the action of reactive forces, inter alia because the lateral driving means comprise draw cables arranged on either side of the cutting head and subjected to alternating lengthening and shortening actions due to varying reactive forces so that the cutting members attack the hard ground material in an unefficient and/or inadmissible manner. Since the prior art device of the kind set forth is not suitable for cutting loose stony ground, for example, rock, such hard ground material has hitherto been loosened by explosives. This is an expensive process, particularly, if the ground material has to be exploded into such fragments as can be removed by dredging material.

The invention has for its object to render the device suitable for cutting hard ground material. The device according to the invention is characterized in that in order to avoid harmful motions of the cutting members due to reactive forces the carrier, the tie means and the rotational driving means are substantially free of spring action and the lateral driving means consist of pull- and push-resistant linear hydromotors and the cutting members in sequence in the direction of rotation are arranged on uninterrupted foundations of the cutting head.

According to the invention the reactive forces are conducted back to the ground along a short, rigid path.

The abovementioned and further features of the invention will be described hereinafter with reference to embodiments of devices in accordance with the invention.

In the drawing there show schematically

Figure 2:
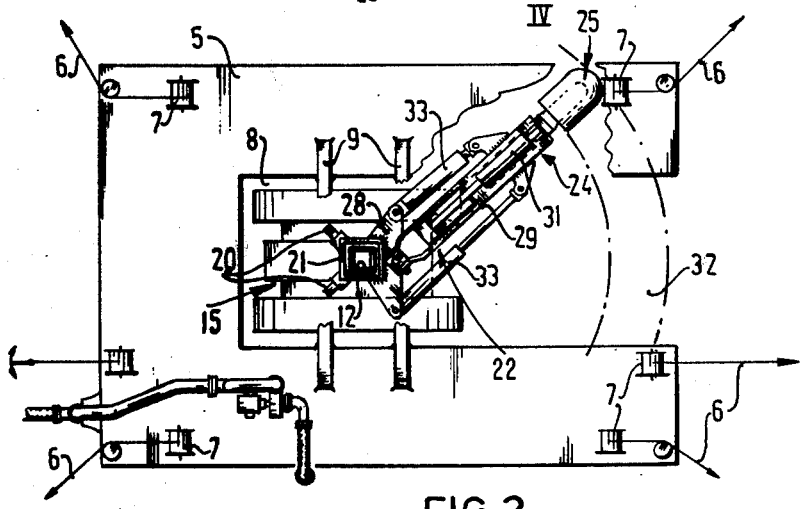
Figure 17:
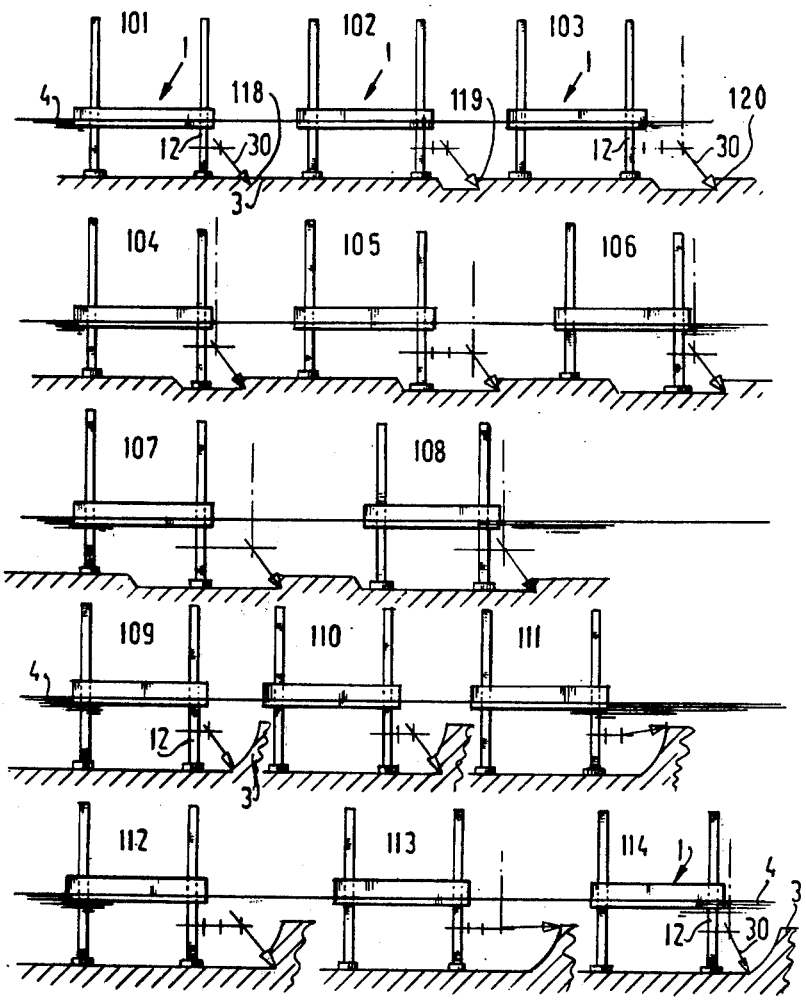

FIGS. 1 and 2 a side elevation and a plan view respectively of a device embodying the invention, FIG. 3 an enlarged perspective view of detail III in FIG. 1, FIG. 4 an enlarged side elevation of detail IV in FIG. 1, FIGS. 5 and 6 a side elevation and a plan view respectively of a further developed device embodying the invention, FIG. 7 an enlarged side elevation of detail VII in FIG. 5, FIG. 8 a sectional view taken on the line VIII—VIII in FIG. 7, FIG. 9 a sectional view taken on the line IX—IX in FIG. 7, FIG. 10 a sectional view taken on the line X—X in FIG. 7, FIG. 11 on an enlarged scale detail XI of FIG. 5, FIGS. 12 and 13 on an enlarged scale a variant of detail XII in FIG. 5, FIGS. 14 and 15 on an enlarged scale each a variant of detail XIV in FIG. 5, FIG. 16 a further development of detail XVI of FIG. 7 and FIG. 17 a survey of successive work phases of a device mainly as shown in FIG. 1.

Referring to FIGS. 1 to 4, the device 1 for cutting loose hard ground material 2 from a ground 3 under the water 4 comprises a body 5 floating on the water 4 and to be anchored to the ground 3 by means of cables 6 of winches 7. The floating body 5 comprises a loft 8, above which is disposed a yoke 9. In the yoke 9 a tube 10 is cardanically suspended by means of a Cardan joint 11. In the tube 10 a work pile 12 is guided vertically and adapted to be lifted and lowered by means of a hoisting cable 13 of a winch 14 fastened to the tube 10.

The work pile 12 carries a ground support 15 formed in this device 1 by a carriage 18 travelling on caterpillars 17 along the ground 3. A console 19 erected on the carriage 18 is connected through a cardan hinge 16 with the lower end of the work pile 12. The console 29 of the ground support 15 is engaged by clamping means formed by a clamping sleeve 21 with hydraulic clamps 20. The device 1 comprises furthermore a cutting head 25 provided with cutting members 23, rotatably driven by rotational driving means and rotatably journalled on a carrier 24 and tie means 22 connecting the carrier 24 with the ground support 15. The tie means 22 consist of a rotary stool 26 adapted to turn about a vertical axis 27 and journalled in extensions 28 of the clamping sleeve 21. The carrier 24 of a short and rigid structure comprises two telescopically co-operating carrier portions 29 and 30, which are relatively slidable in a clearance-free and nonresilient manner by means of a pull- and push-resistant, linear hydromotor 31. The carrier portion 29 is connected in a clearance-free manner with the rotary stool 26 by means of horizontal stub shafts 50 and can be turned around the stub shafts by means of a pull- and push-resistant hydro-motor 53.

The device 1 comprises furthermore lateral driving means engaging the carrier 24 and driving the cutting head 25 along the ground 3 in a cut 32 and formed by pull- and push-resistant, linear hydro-motors 33. The cutting head 25 comprises a body 34 which is coupled with an end of a driving shaft 35 and which is welded to a jacket 36, which is journalled by means of a bearing 37 at the free end 38 of the portion 30 of the carrier 24. The cutting head 24 is provied with cutting members 23 in the form of tines, which are arranged on uninterrupted foundations 39 of the cutting head 25. The jacket 36 has, between foundations 39, a plurality of circumferentially distributed suction apertures 40 of adequate size for passing the fragmented ground material. The suction apertures 40 communicate with a suction chamber 41 located inside the jacket 36 and the carrier portion 30 and communicating through a suction conduit 42 and a pump 43 supported by the carrier portion 30 with a flexible pressure conduit 44 and through a pump 45 carried by the floating body 5 with a transport conduit 46. The foundations 39 form part of an uninterrupted, robust worm conveyor on which the sequential cutting members 23 are arranged in a circumferential direction in order of succession on the cutting head 25 in a non-resilient manner. Not only the cutting members 23 are arranged on the cutting head 25 in a non-resilient manner, but also the cutting head 25 is journalled on the carrier portion 30 in a play-free manner, the carrier portions 29 and 30 are interconnected by means of a clearance-free star-wedge joint 47 in a torsion-resistant manner, the carrier portions 29 and 30 are resistant to bending and the tie means 22 and the clamps 20 are constructed in a play-free and robust manner so that the reactive forces produced during cutting are conducted from the cutting member 23 back to the ground 3 substantially without spring action and without clearance along a comparatively rigid and short path via the ground support 15, the cutting means 23 being thus kept firmly in their prescribed path. In order to prevent the cutting members 23 from chopping the hard ground whilst vibrating along their path, the cutting head 25 is driven by non-resilient and backlash-free rotational driving means formed by a comparatively short and rugged driving shaft 35, a robust, play-free planetary gear wheel drive 48 and a rugged motor shaft 52 of an electric motor 49.

The same motor shaft 52 drives through a driving gear 51 the pump 43. The rotational driving means of the cutting head 25 are preferably formed by a rotational hydro-motor which directly drives the cutting head 25.

In order to firmly anchor the ground support 15 to the ground 3, it is loaded with part of the weight of the floating body 5. For this purpose the floating body 5, as shown in FIG. 1, bears on the top end of the work pile 12 by way of a hydro-pneumatic cylinder 54 communicating with a gas accumulator 55 and comprising a piston 56 with a piston rod 57. The top end of the piston rod 57 is provided with a guide disc 58 of a cable 59, which is connected on the one hand with the tube 10 and on the other hand with a winch 60 carried by the tube 10. The more the cable 59 is tightened, the more will be compressed the gas in the accumulator 55 and the greater will be the part of the weight of the floating body 5 transferred to the work pile 12 and hence to the ground support 15. The upward and downward movements of the floating body 5 due to sea are compensated for in the gas accumulator.

The device 1 shown in FIGS. 5 to 11 comprises a floating body 5 which is held in the working position via two work piles 12 and two supporting piles 61 on the ground 3 through clamping mechanisms 62 of known type. In order to press the ground supports 15 sufficiently home at the lower ends of the work piles 12 the floating body is lifted along the work piles 12 and the supporting piles 61. If an even higher supporting pressure is required for the ground supports 15, the ballast tanks 63 of the floating body 5 are filled with water by means of a pump 64. This device 1 comprises two carriers 24 as shown in FIG. 6, each having a cutting head 25 as shown in FIG. 11, differing from the cutting head 25 of FIG. 3 in that suction apertures are dispensed with. The removal of cut up ground material 2 is performed by means of a separate suction pipe 65 with a suction nozzle 66, which communicates through a flexible conduit 42, a pump 43, a flexible conduit 44 and a conduit 67 carried by the floating body 5 with a loading pipe 68, which sheds the ground material 2 in a vessel 69.

The floating body 5 shown in its lowermost working position in FIG. 7, engages by hydraulically energized clamps 70 of clamping mechanisms 62 the guide rails 71 of the work piles 12, the ground supports 15 of which have pivotable toes 72 penetrating into the ground 3. Each work pile 12 has at the front clamping means 74 including a sledge 75 gripping around guide rails 73 and clamped to the guide rails 73 by hydraulically operated clamps 20 (see FIGS. 7 and 8). The sledge 75 carries a console 76, in which a rotary stool 26 is rotatable about a vertical axis 27 by means of a clearance-free barrel bearing 77. The rotary stool 26 comprises an upper arm 78, to which is pivotally suspended a carrier portion 29 of a carrier 24 by means of horizontal stub shafts 79. A further portion 30 of the carrier 24 is pivotable by means of horizontal stub shafts 80 with respect to the carrier portion 29 with the aid of a pull- and push-resistant, linear hydro-motor 81, which is pivotally arranged between ears 82 of the carrier portion 29 and ears 83 of the carrier portion 30. The rotary stool 26 has at the lower end ears 84 in which is pivotally arranged by means of horizontal stub shafts 85, a pull- and push-resistant, linear hydro-motor 53, which engages the carrier portion 29 by means of a horizontal pin 86. By displacement of the hydro-motors 53 and 81 the carrier 24 can be turned from the starting position indicated by solid lines in FIG. 7 into the foremost, highest positions indicated by broken lines. In the highest position shown in FIG. 7, the cutting head 25 cuts loose ground material 2 at a level H above the water 4. Two curved rods 88 are pivotable about a horizontal pin 89 and suspended in ears 87 of the upper arm 78 and pivotally connected by means of horizontal pins 90 with arms 91 of knee levers 92 pivotally connected by the stub shafts 80 with the carrier portion 30 and fixedly connected with the suction pipe 65. By the parallel rod system formed by (1) the upper arm 78 between the pins 89 and the stub shafts 79,
(2) the equal portion of the arm 91 between the pins 90 and the stub shafts 80,
(3) the curved rods 88 between the pins 89 and 90 and
(4) the equal portion of the carrier portions 29 between the stub shafts 79 and 80, the suction pipe 65 is held at a constant angle a to the horizontal during a displacement of the carrier 24 by means of the hydro-motor 53. In order to hold the suction nozzle 66 at the required level above the ground 3, the suction pipe 65 is telescopically adjustable by means of a linear hydro-motor 93.

The rotary stool 26 is pivotable about the vertical axis 27 by means of pull- and push-resistant, linear hydro-motors 33 for the lateral drive of the cutting head 25 along a horizontal cut in the ground 3, whilst the suction nozzle 66 moves simultaneously and sucks up the ground material 2 cut loose by the cutting head 25. When the carrier portion 24 turns upwards about the stub shafts 80, the suction nozzle 66 remains at its level above the ground 3 and sucks up the loosened ground material 2 dropping down. The pump 43 is arranged on a console 94 fastened to the sledge 75.

The device 1 of FIG. 12 is distinguished from that of FIG. 5 in that the carrier 24 and its tie means 22 are of the type shown in FIGS. 1 and 4, but the clamping means engage, by means of a sledge 75, guide rails 73 of the work pile 12 so that the carrier 24 with the cutting head 25 can be rapidly lifted out of the water 4 into a checking position indicated by broken lines by means of a hoisting cable 13. When very hard ground material 2 has to be cut loose frequent checks and, as the case may be, replacement of the cutting members 23 may be required.

The ground support 15 of FIG. 12 is formed by a serrated cup.

FIG. 13 is distinguished from FIG. 12 in that a clamping sleeve 21 grips around the work pile 12 and the floating body 5 is connected with the work pile 12 by means of a high superstructure so that the carrier 24 can be lifted above the water 4.

The carrier 24 may consist of two carrier portions 29 and 30 pivotally connected with one another as shown in FIG. 7, the carrier portion 30 being constructed as shown in FIG. 14, the suction dredger means being incorporated as shown in FIG. 1 or as shown in FIG. 15, in which case the carrier portion 30 is without suction means and the shaft 35 of the cutting head 25 is directly driven by a rotational hydro-motor 95.

The sledge 75 of the clamping means 74 of FIG. 7 is preferably guided in a clearance-free manner along the guide rails 73 by means of fixed wheels 97 and by means of wheels 99 (see FIG. 16) pressed by linear hydro-motors 98 and journalled in pivotable arms 100.

In each device 1 described above, comprising work piles 12 and supporting piles 61, the supporting piles 61 are displaceable in a horizontal direction 115 by means of a pile carriage 116 and a linear hydro-motor 117.

FIG. 17 illustrates successive work phases 101 to 114. In the work phase 101, the starting phase, and the work phases 102 and 103 the device 1 bears on the same place of the unworked ground 3, whilst a sequence of cuts 118, 119 and 120 are worked by the stepwise advance of the carrier portion 30. After the work phase 103 the device 1 is advanced by one step by means of the pile carriage 116 of FIGS. 5 and 6, the work piles 12 being deposited on the worked ground 3 at a lower level. In the work phases 105 to 108 the device 1 is advanced in the same manner until the device 1 is completely standing on the worked ground 3. Continuing by the work phases 109 to 114 the device 1 gets at an increasing depth until the most effective working depth of the work phase 114 is reached. Then the maximum quantity of ground material 2 can be cut loose in the same positions of the piles 12 and 61.

What we claim is:

1. A device for fragmenting hard ground located below water, comprising in combination:

a buoyant body and at least one work support means for supporting part of the weight of said body by bearing against hard ground beneath said body, said work support means comprising an upright work pile and a ground-engaging support at the lower end of such pile;

a carrier and tie means connecting said carrier at one end to said work support means for allowing the opposite end of the carrier to sweep an arcuate path centered on a vertical axis at least closely adjacent said work pile;

a cutter head rotatably carried by said carrier and projecting beyond said opposite end thereof and driving means for rotating said cutter head, said cutter head including at least one uninterrupted foundation and a plurality of rigid cutting members connected to and projecting from said foundation;

said tie means comprising clamping means releasably engaging said support means for anchoring said carrier thereto, a stool rotatably carried by said clamping means about said vertical axis, and arm means joining said one end of the carrier to said stool for rotational movement therewith and for movement about a horizontal axis;

lateral driving means connecting said clamping means to said carrier for swinging the latter about said vertical axis, said lateral driving means comprising at least one linear hydro-motor;

vertical driving means connecting said clamping means to said carrier for swinging the latter about said horizontal axis, said vertical driving means comprising at least one linear hydro-motor; and which means on said body for raising and lowering said carrier and said tie means bodily as a unit.

2. A device as claimed in claim 1 wherein said ground support is arranged at the lower end of the work pile and consists of a carriage travelling on caterpillars along the ground.

3. A device as claimed in claim 1 wherein said body is provided with a plurality of piles, at least two of which serve as work piles, each being provided with a cutting head.

4. A device as claimed in claim 3 wherein the clamping means comprise a hoisting carriage, which is adapted to travel by its wheels along a guide arranged on said work pile.

5. A device as claimed in anyone of claims 1, 2, 3, or 4 including a ballast tank for raising the supporting pressure on each work pile.

6. A device as claimed in claim 5 including adjusting means for varying and fixing the distance of the cutting head from the work pile.

7. A device as claimed in claim 5 including a suction pipe with a suction nozzle suspended to the tie means for sucking away the ground material cut loose.

8. A device as claimed in claim 12 wherein said work support means is telescopically adjustable by means of at least one linear hydraulic motor.

9. A device as claimed in anyone of claims 1, 2, 3, 4 or 8 including adjusting means for varying and fixing the distance of the cutting head from the work pile.

10. A device as claimed in claim 9 including a suction pipe with a suction nozzle suspended to the tie means for sucking away the ground material cut loose.

11. A device as defined in claims 12, 3, 4, 5 or 8 including a suction pipe with a suction nozzle suspended to the tie means for sucking away the ground material cut loose.

12. A device as claimed in claim 11 including means for adjusting the cutting head to varying levels above the suction nozzle.

13. A device as claimed in claim 12 including means for displacing the suction nozzle of the suction pipe in the direction of length of the suction pipe.

14. A device as claimed in claim 11 including means for displacing the suction nozzle of the suction pipe in the direction of length of the suction pipe.

15. A device for fragmenting hard ground located below water, comprising in combination:

a buoyant body and at least one work support means for supporting part of the weight of said body by bearing against hard ground beneath said body, and means for causing said work support means to bear against such hard ground;

a cutter assembly adapted to be releasably anchored to said work support means; and winch means on said body for raising and lowering said cutter assembly bodily as a unit;

said cutter assembly comprising a short, rigid carrier, clamping means for releasably engaging said work support means, tie means connecting said clamping means to one end of said carrier for allowing sweeping movements of said carrier both about a vertical axis and about a horizontal axis which are at least closely adjacent said work support means, linear hydro-motor means connecting said clamping means to said carrier for independently sweeping said carrier about said axes, a cutter head rotatably carried by said carrier and projecting from the opposite end thereof, and drive means for rotating said cutter head.

* * * * *